US008801252B2

(12) United States Patent
Gava

(10) Patent No.: US 8,801,252 B2
(45) Date of Patent: Aug. 12, 2014

(54) MULTI-FUNCTIONAL PROJECTOR LAMP SHIELD AND MULTI-FUNCTIONAL PROJECTOR EMBODYING SUCH A SHIELD

(75) Inventor: Michael Gava, Ann Arbor, MI (US)

(73) Assignees: Hyundai America Technical Center, Inc., Superior Township, MI (US); Hyundai Motor Company, Seoul (KR); Kia Motors Corporation, Seoul (KR)

( * ) Notice: Subject to any disclaimer, the term of this patent is extended or adjusted under 35 U.S.C. 154(b) by 335 days.

(21) Appl. No.: 13/284,407

(22) Filed: Oct. 28, 2011

(65) Prior Publication Data

US 2013/0107559 A1 May 2, 2013

(51) Int. Cl.
*F21V 1/00* (2006.01)

(52) U.S. Cl.
USPC ..... 362/539; 362/516

(58) Field of Classification Search
USPC ..... 362/538, 539, 346, 332, 309, 509, 516, 362/464–466
See application file for complete search history.

(56) References Cited

U.S. PATENT DOCUMENTS

| | | | | |
|---|---|---|---|---|
| 4,323,952 | A * | 4/1982 | Proske | 362/17 |
| 5,023,758 | A * | 6/1991 | Allen et al. | 362/514 |
| 5,023,788 | A * | 6/1991 | Kitazume et al. | 701/82 |
| 5,764,316 | A * | 6/1998 | Takizawa et al. | 349/1 |
| 7,575,353 | B2 | 8/2009 | Oyama | |
| 2004/0223338 | A1 * | 11/2004 | Koike et al. | 362/545 |
| 2005/0073853 | A1 * | 4/2005 | Stam | 362/503 |
| 2006/0039160 | A1 * | 2/2006 | Cassarly et al. | 362/551 |
| 2007/0121046 | A1 * | 5/2007 | Toko | 349/127 |
| 2009/0279316 | A1 * | 11/2009 | Hikmet et al. | 362/465 |
| 2011/0305029 | A1 * | 12/2011 | Chuang et al. | 362/464 |

FOREIGN PATENT DOCUMENTS

| | | | |
|---|---|---|---|
| JP | 2007-250327 | A | 9/2007 |
| JP | 2009-266758 | A | 11/2009 |
| KR | 20090131481 | A | 12/2009 |

* cited by examiner

*Primary Examiner* — John A Ward
(74) *Attorney, Agent, or Firm* — Edwards Wildman Palmer LLP; Peter F. Corless

(57) ABSTRACT

Featured is a multi-functional light shielding plate to establish a desired light distribution pattern to light traveling in an illumination direction that is received from at least one of a light source or a reflector. Such a light shielding plate includes a light shielding portion that is selectively configurable to be one of light transmissive or a light blocker and also includes a support mechanism that supports the light shielding portion so as to maintain the light shielding portion in fixed relation with respect to the light source. When configured as a light blocker, the light shielding portion is configured so that light traveling in the illumination direction is substantially blocked from passing through the light shielding portion and when configured so as to be transmissive, the light shielding portion is configured so that said light traveling in the illumination direction passes substantially through the light shielding plate.

29 Claims, 8 Drawing Sheets

LOW BEAM

HIGH BEAM

MULTI-FUNCTIONAL PROJECTOR LAMP SHIELD AND MULTI-FUNCTIONAL PROJECTOR EMBODYING SUCH A SHIELD

FIELD OF INVENTION

The present invention generally relates to a projector-type lighting device such as a headlight for a vehicle (e.g., motor vehicle) and more particularly to a projector-type lighting device having a light shield so as to selectively cut-off a portion of the light being generated or to allow substantially all of the light being generated to be projected from the lighting device. In yet more particular aspects the light shield is fixed or non-moving within the projector-type lighting device.

BACKGROUND OF THE INVENTION

A headlamp is a lamp usually attached to the front of a vehicle such as a car, with the purpose of illuminating the road ahead during periods of low visibility, such as darkness or precipitation. Headlamp performance has steadily improved throughout the automobile age, spurred by the great disparity between daytime and nighttime traffic fatalities. The U.S. National highway Traffic Safety Administration has indicated that nearly half of all traffic-related fatalities occur in the dark, despite only 25% of traffic traveling during darkness. Varghese, Cheman; Shankar, Umesh (May 2007). Passenger Vehicle Occupant Fatalities by Day and Night—A Contrast; *Traffic Safety Facts, Research Note* (*DOT HS* 810 637) (NHTSA's National Center for Statistics and Analysis) http:www-nrd.nhsta.dot.gov/Pubs/810637.pdf. While it is common for the term headlight to be used interchangeably in informal discussion, headlamp is the technically correct term for the device itself, while headlight properly refers to the beam of light produced and distributed by the device.

In the beginning, there were no headlamps for horseless carriages or automobiles. When the early adopters of the horseless carriage had to drive at night, they did the same thing that regular carriages did, hang a kerosene lantern on the front of their vehicle. The earliest headlamps were fueled by acetylene or oil and were introduced in the late 1880s. Acetylene lamps were popular because the flame was resistant to wind and rain.

This was not an ideal solution, so people began experimenting with electric headlamps. The first electric headlamps were introduced in 1898. Two factors limited the widespread use of electric headlamps: the short life of filaments in the harsh automotive environment, and the difficulty of producing dynamos small enough, yet powerful enough to produce sufficient current. Georgano, G. N. (2002). *Cars: Early and Vintage,* 1886-1930 (*A World of Wheels Series*, Mason Crest. Peerless made electrical headlamps standard in 1908. When mounted to the vehicle, these lamps were aimed straight forward at that time.

In 1912, Cadillac integrated their vehicle's Delco electrical ignition and lighting system, creating the modern vehicle electrical system and in 1917, Cadillac began selling cars with "dipping" headlamps, which could be angled via a lever to point towards the ground in front of the car. Eventually, these two aiming positions became known as "low beams" and "high beams". The situation has not changed much since then, with all cars having both low and high beams, with nothing in between, despite the lack of evidence that only two lighting positions is ideal. In a study funded by the NHTSA, it was found that people had trouble quickly choosing and switching between more than two positions. There is currently a push in the industry towards implementing headlamp technology that will intelligently and automatically control the switching to provide effective, middle distance lighting.

In contrast to the stagnation in the evolution of how headlamps are used, the technology behind them has changed dramatically since the dawn of the twentieth century. Automobile manufacturers went from using acetylene or oil-filled lanterns to incandescent bulbs to halogen bulbs to the current state-of-the-art, High Intensity Discharge (also called HID or Xenon) lamps and LEDs. For each different technology, different methods of making the switch between low and high beams had to be invented. The general method, as shown in FIG. 1, used with HID lamps is to have a solenoid-activated lever or a motor-activated mechanism physically move a metal shield into the path of the light beam, blocking the portion that would exit the top of the lamp, thereby "turning off" the high beams.

There is found in JP publication No. 2007-250327 and in U.S. Pat. No. 7,575,353 (its US counterpart), a lighting device that includes a light shielding plate being configured to impart a required or desired light distribution pattern by shielding light received directly from a light source and/or light reflected from a reflector. The movement of the light shielding plate is achieved by rotation about a vertical rotary shaft. In an embodiment of the described invention, the light shielding plate is a drum-type movable light shielding plate.

There is found in JP Publication No. 2009-266758, a double object headlight that emits light with a cutoff, in particular a low beam as a first function and emits a high beam as a second function. Such a headlight includes a pull-in type shade plate capable of taking an operation position for low beam emission and a pull-in position for high beam emission. The upper edge for the cutoff is located in the vicinity of the focal point of the lens at the operation position. In the pull-in position, the upper edge of the cutoff is located in a lower part of the reflecting mirror when the shade plate is rotated to the front side to function as a reflecting surface and thus contribute to the emission of the high beam.

There is found in Korean Publication No. 1020091031481, a shield for a vehicle headlamp having an inclined surface in the end portion of protrusions. The shield includes a vertical surface in the outer side of the protrusions so as to facilitate the separation of the mold after manufacturing of the shield is completed. The main body of the shield is pivotally installed and includes a protrusion is provided in the main body to block a part of light coming from the light source.

There also is shown in FIGS. 3A, B a cross-sectional schematic view of a headlamp for a Lincoln MKS. In FIG. 3A, the headlamp is shown configured for low beam operation where the shield is disposed so as to block a portion of the light coming from the light source and/or reflected from the reflector. The headlamp when configured for high beam operation is shown in FIG. 3B. When in high beam operation, the shield is rotated or moved so to be tipped in a forward direction and so it is no longer in the path of emanating light beam.

The use of a rotating shield such as shown in FIGS. 1 and 3 works, however, it is far from ideal. The chief shortcoming of such a rotating shield is its lack of flexibility. Because the rules governing headlamp patterns are different in the United States than in the rest of the world, auto manufacturers have to make different styles of headlamps for the United States, Europe and Asia, as well as different headlamps for left- or right-sided driving. Further such mechanisms are not readily adaptable to provide mid-distance lighting.

In general, headlamps presently in use are electrically operated and form a headlamp system where the headlamps are positioned in pairs, one or two headlamps on each side of the front of a vehicle. Such a headlamp system for a vehicle is required to produce a low and a high beam, which may be achieved either by an individual lamp for each function or by a single multifunction lamp.

High beams (also called "main beams" or "full beams" or "driving beams" in some countries) cast most of their light straight ahead, maximizing the seeing distance, but producing too much glare for safe use when other vehicles are present on the road. Also, because there is no special control of upward light, high beams also cause back dazzle from fog, rain and snow due to the retroreflection of the water droplets. Low beams (called "dipped beams" in some countries) have stricter control of upward light, and direct most of their light downward and either rightward (in right-traffic countries) or leftward (in left-traffic countries), to provide safe forward visibility without excessive glare or back dazzle.

Low beam (dipped beam, passing beam, meeting beam) headlamps provide a distribution of light designed to provide adequate forward and lateral illumination with limits on light directed towards the eyes of other road users, to control glare. This beam is intended for use whenever other vehicles are present ahead. The International ECE Regulations for filament headlamps and for high-intensity discharge headlamps specify a beam with a sharp, asymmetric cutoff preventing significant amounts of light from being cast into the eyes of drivers of preceding or oncoming cars. Control of glare is less strict in the North American SAE beam standard contained in FMVSS/CMVSS 108.

Most low-beam headlamps are specifically designed for use on only one side of the road. Headlamps for use in left-traffic countries have low-beam headlamps that "dip to the left"; the light is distributed with a downward/leftward bias to show the driver the road and signs ahead without blinding oncoming traffic. Headlamps for right-traffic countries have low beams that "dip to the right", with most of their light directed downward/rightward.

Within Europe, when driving a vehicle with right hand (RH) traffic headlamps in a left hand (LH) traffic country or vice versa for a limited time (as for example on vacation or in transit), it is a legal requirement to adjust the headlamps temporarily so that the wrong-side hot spot of the beam does not dazzle oncoming drivers. This may be achieved by adhering blackout strips or plastic prismatic lenses to a designated part of the lens. Many tungsten (pre-halogen) European-code headlamps made in France by Cibié, Marchal, and Ducellier could be adjusted to produce either a left- or a right-traffic low beam by means of a two-position bulb holder. More recently, some projector-type headlamps can be made to produce a proper left- or right-traffic beam by shifting a lever or other movable element in or on the lamp assembly. Because wrong-side-of-road headlamps blind oncoming drivers and do not adequately light the driver's way, and blackout strips and adhesive prismatic lenses reduce the safety performance of the headlamps, most countries require all vehicles registered or used on a permanent or semi-permanent basis within the country to be equipped with headlamps designed for the correct traffic-handedness.

As to HID lamps and with reference also to FIG. 1, HID lamps produce light from a millimeter-sized electric arc passing through a compressed mixture of xenon and metal halide gases contained in a light bulb or capsule. Because the light-generating region is so small, it can be placed at one focus of an elliptical reflector. Due to the geometry of an ellipse, all of the light will be concentrated at the second focus of the ellipse, (approximately where the movable plate is located). Past the second focus, the light continues to expand until it passes through lens (e.g., a convex lens), which gives the light beam its final shape.

HID lamps produce more light for a given level of power consumption than the halogen lamp technology they can displace. They also produce a different spectrum of emitted light, some of which is in the near infrared range, which results in significant heating of materials directly in the path of a concentrated beam of light. An illustrative spectrum of emitted light for an HID lamp is shown in FIG. 2.

Automotive HID lamps are commonly called "xenon headlamps", though they are actually metal halide lamps that contain xenon gas. The xenon gas allows the lamps to produce minimally adequate light immediately upon power up, and accelerates the lamps' run-up time. If argon were used instead, as is commonly done in street lights and other stationary metal halide lamp applications, it would take several minutes for the lamps to reach their full output. The light from HID headlamps exhibits a distinct bluish tint when compared with tungsten-filament headlamps.

HID headlamp bulbs do not run on low-voltage DC current, so they require a ballast with either an internal or external igniter. The ballast controls the current to the bulb. Typically, the ignition and ballast operation proceeds in three stages. Also, HID headlamp burners produce between 2,800 and 3,500 lumens using from between 35 and 38 watts of electrical power, while halogen filament headlamp bulbs produce between 700 and 2,100 lumens using from between 40 and 72 watts. The reduced power consumption means less fuel consumption, with resultant less $CO_2$ emission per vehicle fitted with HID lighting.

If the higher-output HID light source is used in a well-engineered headlamp optic, the driver gets more usable light. Studies have demonstrated drivers react faster and more accurately to roadway obstacles with good HID headlamps rather than halogen ones. The contrary argument is that HID headlamps can negatively impact the vision of oncoming traffic due to their high intensity and "flashing" effect due to the rapid transition between low and high illumination in the field of illumination, thus increasing the risk of a head-on collision between the HID-enabled vehicle and a blinded oncoming driver.

The above information disclosed in this Background section is only for enhancement of understanding of the background of the invention and therefore it may contain information that does not form the prior art that is already known in this country to a person of ordinary skill in the art.

It thus would be desirable to provide a multi-functional projector lamp shield and a multi-functional projector embodying such a shield. It would be particularly desirable to provide such a multi-functional lamp shield device and a multi-functional projector embodying such a shield where the shield is not movable such as by mechanical devices such as those required when using prior art shields. It also would be desirable to provide such a multi-functional shield and multi-functional lamp that can be easily adapted for use with different types of vehicles and differing regulatory requirements.

SUMMARY OF THE INVENTION

The present invention features a multi-functional light shielding plate to establish a desired light distribution pattern to light traveling in an illumination direction that is received from at least one of a light source or a reflector. Also featured are a lighting device and a vehicle lighting device having such a shielding plate.

Such a light shielding plate includes a light shielding portion that is selectively configurable to be one of light transmissive or a light blocker and also includes a support mechanism that supports the light shielding portion so as to maintain the light shielding portion in fixed relation with respect to the light source. When configured as a light blocker, the light shielding portion is configured so that light traveling in the illumination direction is substantially blocked from passing through the light shielding portion and when configured so as to be transmissive, the light shielding portion is configured so that said light traveling in the illumination direction passes substantially through the light shielding plate.

According to one aspect of the present invention, there is featured a multi-functional light shielding plate configured to establish a desired light distribution pattern to light traveling in an illumination direction that is received from at least one of a light source or a reflector. Such a multi-functional light shielding plate includes a light shielding portion that is selectively configurable so as to be one of transmissive to said light traveling in the illumination direction or a light blocker to such light and a support mechanism that supports the light shielding portion so as to maintain the light shielding portion in fixed relation with respect to the light source.

When configured as a light blocker, the light shielding portion is configured so that said light traveling in the illumination direction is substantially blocked from passing through the light shielding portion and thus forming a first light distribution pattern. Also, when configured so as to be transmissive, the light shielding portion is configured so that said light traveling in the illumination direction passes substantially through the light shielding plate and thus forms a second light distribution pattern.

In further embodiments, the light shielding portion of such a multi-functional light shielding plate is further configurable so that one segment of the light shielding portion is configured as being transmissive and so a second segment of the light shielding portion is configured as a light blocker, thereby forming a third light distribution pattern.

In yet further embodiments, the light shielding portion is configured with a main segment and two auxiliary segments, the main segment and each of the auxiliary segments being selectively configurable so as to be one of transmissive or a light blocker. When the light shield portion main segment is configured as a light blocker, the main segment is configured so that the light traveling in the illumination direction is substantially blocked from passing through the main segment. Also, the two side segments are configured so one side segment is a light blocker and the other side segment is transmissive when the main segment is configured as a light blocker, whereby the main and two auxiliary segments form a fourth light distribution pattern. In more particular embodiments, the side segments are respectively configured as being a light blocker and light transmissive so that the formed light distribution pattern is compatible with traffic directionality requirements for the country in which the vehicle is traveling on a permanent or semi-permanent basis.

In yet further embodiments, the light shielding portion is configured so as to include a plurality of strip segments each strip segment being selectively configurable so as to be one of transmissive or a light blocker. The plurality of strip segments are arranged so as to be substantially parallel to each other and, more particularly, so that one axis of each strip segment extends widthwise in a first direction that is substantially perpendicular to the direction of the light traveling in the illumination direction and so that another axis of each segment substantially extends vertically in a second direction that is substantially perpendicular to the direction of the light traveling in the illumination direction. In yet further embodiments the first and second directions are substantially perpendicular to each other. In such an embodiment, the strip segments are configurable so that one of (a) all strip segments are configured for light blocking, (b) all strip segments are configured for light transmission or (c) some of the strip segments are configured for light transmission and other of the strip segments are configured for light blocking. When all strip segments are configured as a light blocker, each strip segment is configured so that the light traveling in the illumination direction is substantially blocked from passing through all of the strip segments. When all strip segments are configured so as to be light transmissive, each strip segment is configured so that the light traveling in the illumination direction passes substantially through all of the strip segments.

When some of the strip segments are configured as light transmissive and the others are configured as light blocking, some of the light traveling in the illumination direction passes substantially through the transmissive strip segment(s) and other of the light traveling in the illumination direction is substantially blocked from passing through the blocking strip segments. when in such a configuration, the strip segments can form one or more light distribution patterns that are different from each other. In more particular embodiments, such configurations can be used to create light patterns that illuminate roads and the like at an intermediate distance namely that illuminated between a low beam and high beam.

In yet further embodiments, the light shielding portion includes an electrically switchable material whose light transmission properties change when voltage is applied to the electrically switchable material. Such electrically switchable material is selected from the group consisting of a suspended particle device, a polymer dispersed liquid crystal, an electrochromic device and a reflective hydride. In more particular embodiments, such electrically switchable material includes an electrically switchable display panel as is known to those skilled, including but not limited to an electrically switchable glass or glazing.

According to another aspect of the present invention, there is featured a multi-functional projection type lighting device that includes a light source and a multi-functional light shielding plate to establish a desired light distribution pattern to light traveling in an illumination direction that is received from at least the light source or a reflector. Such a multi-functional light shielding plate includes a light shielding portion that is selectively configurable so as to be one of transmissive to said light traveling in the illumination direction or a light blocker and a support mechanism that supports the light shielding portion so as to maintain the light shielding portion in fixed relation with respect to the light source.

When configured as a light blocker, the light shielding portion is configured so that the light traveling in the illumination direction is substantially blocked from passing through the light shielding portion and thus forms a first light distribution pattern. When configured so as to be transmissive, the light shielding portion is configured so that the light traveling in the illumination direction passes substantially through the light shielding plate and thus forms a second light distribution pattern.

In further embodiments, such a multi-functional projection type lighting device further includes a reflector and/or a lens. The reflector is arranged so it reflects light from the light source in the illumination direction and the multi-functional light shielding plate is configured so as to establish a desired light distribution pattern to light traveling in an illumination direction that is received from at least one of a light source or a reflector. The lens is arranged so that a beam of light in the illumination direction passes through the lens and so the lens gives the light beam its final shape.

In further embodiments, the light shielding portion of such a multi-functional projection type lighting device, is further configurable so one segment of the light shielding portion is configured as being transmissive and so a second segment of the light shielding portion is configured as a light blocker, thereby forming a third light distribution pattern.

In yet further embodiments, the light shielding portion is configured with a main segment and two auxiliary segments, the main segment and each of the auxiliary segments being selectively configurable so as to be one of transmissive or a light blocker. When the light shield portion main segment is configured as a light blocker, the main segment is configured so that the light traveling in the illumination direction is substantially blocked from passing through the main segment and the two side segments are configured so one side segment is a light blocker and the other side segment is transmissive when the main segment is configured as a light blocker, whereby the main and two auxiliary segments form a fourth light distribution pattern. In more particular embodiments, the side segments are respectively configured as being a light blocker and light transmissive so that the formed light distribution pattern is compatible with traffic directionality requirements for the country in which the vehicle is traveling on a permanent or semi-permanent basis.

In yet further embodiments, the light shielding portion includes an electrically switchable material whose light transmission properties change when voltage is applied to the electrically switchable material. Also, such electrically switchable material is selected from the group consisting of a suspended particle device, a polymer dispersed liquid crystal, an electrochromic device and a reflective hydride. In yet more particular embodiments, such electrically switchable material includes an electrically switchable display panel as is known to those skilled, including but not limited an electrically switchable glass or glazing.

In yet further embodiments, such a multi-functional projection type lighting device further includes a housing; wherein the light source is mechanically coupled to the housing so as to secure the light source in fixed relation to the housing; and wherein the support mechanism is mechanically coupled to the housing, whereby the light shielding portion is maintained in fixed relation to the housing and thus also with respect to light source.

In yet further aspects of the present invention, there is featured a vehicle lighting device including a light source, a reflector that is arranged so it reflects light from the light source in the illumination direction, a lens that is arranged so that a beam of light in the illumination direction passes through the lens and configured so the lens gives the light beam its final shape and a multi-functional light shielding plate configured so as to establish a desired light distribution pattern to light traveling in an illumination direction that is received from at least the light source or a reflector.

Such a multi-functional light shielding plate includes a light shielding portion that is selectively configurable so as to be one of transmissive to said light traveling in the illumination direction or a light blocker, and includes a support mechanism that supports the light shielding portion so as to maintain the light shielding portion in fixed relation with respect to the light source. When configured as a light blocker, the light shielding portion is configured so that the light traveling in the illumination direction is substantially blocked from passing through the light shielding portion and thus forms a first light distribution pattern. When configured so as to be transmissive, the light shielding portion is configured so that said light traveling in the illumination direction passes substantially through the light shielding plate and thus forms a second light distribution pattern.

In further embodiments, the light shielding portion includes an electrically switchable material whose light transmission properties change when voltage is applied to the electrically switchable material. Such an electrically switchable material is selected from the group consisting of a suspended particle device, a polymer dispersed liquid crystal, an electrochromic device and a reflective hydride. In more particular embodiments, such electrically switchable material includes an electrically switchable display panel as is known to those skilled, including but not limited an electrically switchable glass or glazing.

In yet further embodiments, such a vehicle lighting device further includes a housing. The light source is mechanically coupled to the housing so as to secure the light source in fixed relation to the housing. Also, the support mechanism is mechanically coupled to the housing, whereby the light shielding portion is maintained in fixed relation to the housing and thus also with respect to light source.

In yet further embodiments, the light source for any of the aspects or embodiments described herein includes a high intensity discharge (HID) type of light source.

In yet further aspects of the present invention, such multi-functional light shielding plates, multi-functional projector lamps and vehicle lighting devices further includes a controller or control mechanism/device that is operably coupled to light shielding portion, where the controller is configured and arranged so as to control the operational configuration of the light shielding portion. More particularly, the controller is configured so as to cause the light shielding portion to be selectively configured as one of transmissive or a light blocker.

In embodiments, such a controller includes a digital processing device, microprocessor or the like that includes a software program for execution on such a digital processor or microprocessor. Such software includes code segments, instructions and criteria for determining from various inputs the appropriate operational configuration for the light shielding portion such that a desired light distribution pattern is being outputted (e.g., high bean or low beam light distribution pattern).

In yet further embodiments, such multi-functional light shielding plates, multi-functional projector lamps and vehicle lighting devices further include one or more power supplies operably coupled to the controller so that the controller can selectively energize or de-energize the light shielding portion so as to thereby selectively cause the light shielding portion to be one of transmissive or lighting blocking.

In yet further embodiments, such a light shielding portion is configured so as to include a at least a plurality of regions that each can be selectively controlled so as to be transmissive or light blocking. In more particular embodiments, the controller is configured so as to control each of the plurality of regions such that one or more regions can be configured so as to be transmissive and so that one or more other regions can be configured so as to be light blocking at the same time.

Such multi-functional light shielding plates, multi-functional projector lamps, and vehicle lighting devices of the present invention have a number of advantageous effects/benefits as compared to conventional devices. As there is no need for a separate high beam source, mass (~0.5 kg/veh) and part count is reduced. In addition, power requirements are also reduced (~110-130 W/veh) as a halogen high beam bulb typically consumes 55-65 W per lamp. Further, the packaging space for the vehicle lighting system becomes reduced due to the elimination of a separate high-beam. The smaller package requirements also allows for increasing styling flexibility as well as providing an opportunity to move other lighting functions into the headlamp assembly.

Other aspects and embodiments of the invention are discussed below.

DEFINITIONS

The instant invention is most clearly understood with reference to the following definitions:

As used in the specification and claims, the singular form "a", "an" and "the" include plural references unless the context clearly dictates otherwise.

As used herein, the term "comprising" or "including" is intended to mean that the compositions, methods, devices, apparatuses and systems include the recited elements, but do not exclude other elements. "Consisting essentially of", when used to define compositions, devices, apparatuses, systems, and methods, shall mean excluding other elements of any essential significance to the combination. Embodiments defined by each of these transition terms are within the scope of this invention.

A computer readable medium shall be understood to mean any article of manufacture that contains data that can be read by a computer. Such computer readable media includes but is not limited to magnetic media, such as a floppy disk, a flexible disk, a hard disk, reel-to-reel tape, cartridge tape, cassette tape or cards; optical media such as CD-ROM and writeable compact disc; magneto-optical media in disc, tape or card form; paper media, such as punched cards and paper tape; and USB drives. More generally, such computer readable media are non-transitory mediums as is known in the art or hereinafter developed.

USP shall be understood to mean U.S. Patent Number, namely a U.S. patent granted by the U.S. Patent and Trademark Office.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). A hybrid vehicle shall be understood to mean a vehicle that has two or more sources of power, for example a vehicle that is both gasoline-powered and electric-powered.

BRIEF DESCRIPTION OF THE DRAWING

For a fuller understanding of the nature and desired objects of the present invention, reference is made to the following detailed description taken in conjunction with the accompanying drawing figures wherein like reference character denote corresponding parts throughout the several views and wherein:

FIGS. 6E-1, F-1 are exploded views of a portion of the reflective hydride device of FIGS. 6E, F respectively.

DESCRIPTION OF THE PREFERRED EMBODIMENT

Figure 4A:
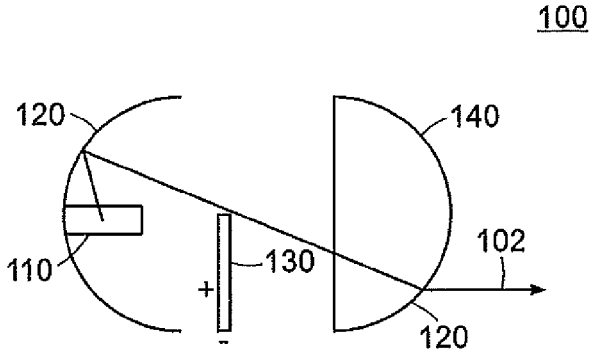
FIG. 4A is a schematic view of a multi-functional projector lamp according to the present invention.
Figure 4B:
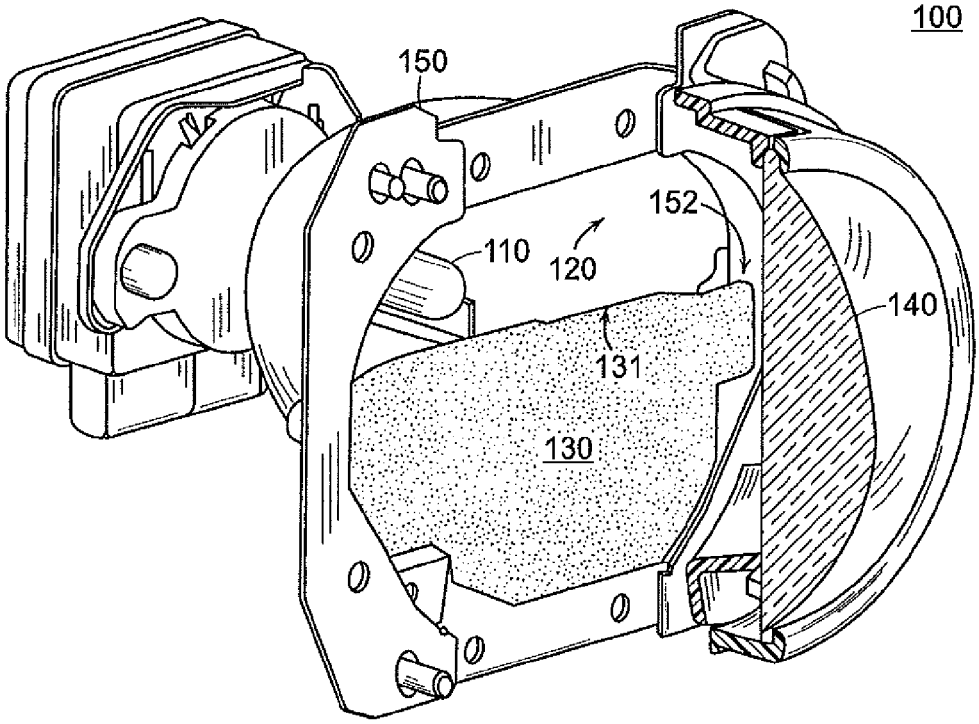
FIG. 4B is an axonometric view of a multi-functional projector lamp according to the present invention.

Referring now to the various figures of the drawing wherein like reference characters refer to like parts, there is shown in FIG. 4A a schematic view of a multi-functional lighting device 100 according to the present invention and in FIG. 4B, an axonometric view of such a multi-functional lighting device 100, wherein like reference character denote corresponding parts throughout the several views.

Such a multi-functional lighting device includes a light source 110, a reflector 120, a light shielding portion 130, a lens 140 and a housing 150. The light source 110 is any of a number of devices or mechanisms known to those skilled in the art of hereinafter developed that generate light at or about any of a number of frequencies and in more particular embodiments, generates light including at least the spectral frequencies for visible light. Such light sources 110 include any light sources for use in vehicles including but not limited to halogen light bulbs or capsules, High Intensity Discharge (also called HID or Xenon) lamps and LEDs. In this regard, such light sources also includes the power and control circuitry necessary for proper operation of a given type of light source (e.g., DC power or AC power circuitry).

The reflector 120 is any of a number of devices or structures that are arrangable in proximity to the light source 110 and configured so that the reflector reflects light emanating from the light source so as to be directed in the illumination direction. As is known in the art, the light from the light source emanates outwardly from the light source in a number of different directions. Thus, to maximize the amount of light in a desired direction, namely the illumination direction, the reflector 120 causes the light emanating in a direction other then the illumination direction to be re-directed into the illumination direction. Thus, the light illuminating the area in front of the vehicle typically is, for example, the light coming directly from the light source 110 and the light being reflected by the reflector into the illumination direction.

In more particular embodiments, the reflector 120 includes a support member that established the general shape and configuration of the reflector and a thin coating or material deposition on a surface of such a support member. The coating or material deposition is further characterized has having good reflective properties after it is applied to or deposited on the support member. In a particular illustrative embodiment, the support member is elliptically shaped and the reflective material is a reflective metal or metal alloy, such metals include aluminum.

The lens 140 in combination with the housing 150 forms an enclosure for general protection of the light source 110 and the reflector 120 from the elements (e.g., light, rain, snow, dust and the like) which could cause the light source 110 to fail and/or significantly degrade the material comprising the reflector 120 as well as cause other functionalities or structure to fail and/or degrade. The lens 140 also is arranged with respect to the light source and secured to the housing 150 so that the beam of light in the illumination direction passes through the lens. The lens 140 also is configured using any of a number of methods or techniques known in the art or hereinafter developed so the lens gives the light beam its final shape. The lens is made of a material appropriate for the intended us and application and includes for example glass or plastic. Such a lens also can include a coating or a material layer to improve the lens resistance to the elements (e.g., UV component of sunlight) which could be a cause for long term degradation of the lens or other components or functionalities of a headlamp.

The housing 150 forms a protective structure and a support structure for the headlamp and functionalities of such a headlamp including for example the electrical connector that electrically couples the light source 110 to a source of electrical power that powers the light source. The housing also includes a mechanism or device that secures the lens 140 to the housing. In addition, the housing 150 includes a mechanism or device that allows the housing to be secured to the vehicle so that the light device is arranged such that light is directed in an appropriate direction from the vehicle.

As indicated above, in an illustrative embodiment internal structure of the housing 150 is configured and arranged to form a support surface or member for the reflector 120. As also described herein, using any of a number of techniques or methods known in the art or hereinafter developed in a an illustrative embodiment a reflective material is deposited or applied on such a support surface or member so as to form a reflector having a desired configuration. In more particular embodiments, such internal structure of the housing is configured so as to form an elliptical reflector.

The housing 150 also further includes a supporting/securing mechanism that supports the light shielding portion 130 from the housing and secures it to the housing so that there is essentially no relative movement between the housing and the light shielding portion. As the light shielding portion 130 is secured to the housing, one can eliminate the structure and functionalities for moving a conventional light shield within the headlamp housing. As also indicated herein, the elimination of this structure and related functionalities allows the headlamp package to be reduced in size and mass.

Such a light shielding portion 130 is secured to the housing with any of number of mechanisms 152 known in the art or hereinafter developed so that the light shielding portion is essentially maintained in fixed relation to the housing. Such mechanisms include but are not limited to mechanical devices (e.g., screws, nuts, clips, clamps, brackets) that removably secure the light shielding portion 130 directly or indirectly to the housing or a structural element (e.g., bracket) of the housing. The foregoing shall not be considered limiting as it is within the scope of the present invention to adapt any of a number of techniques or mechanisms to secure the light shielding portion 130 to the housing 150.

The light shielding portion 130 includes a multi-functional light shielding plate that is configurable so as to selectively establish a desired light distribution pattern to light traveling in an illumination direction that is received from at least the light source and/or a reflector. More particularly, the light shielding portion transitions between a non-transparent state in which some of the light from the light source 110 and from the reflector 120 is blocked by the light shielding portion and a transparent state in which light from the light source and reflector passes there through.

In particular embodiments, the light shielding portion, more specifically the top edge 131 thereof, is configured or established so as to create a light pattern having a cutoff gradient to meet applicable lighting standards for a given country (e.g., FMVSS 108 requirement) as well as to block glare light above the horizon. As also shown in FIG. 4B, the light shielding portion extends horizontally and vertically or downwardly so that light is blocked widthwise or in a horizontal direction across the housing and vertically (e.g., downwardly) from the top edge 131 to the housing.

In addition, such a light shielding portion 130 is further configured and arranged, so that when the headlamp is being operated as a low-beam headlamp (i.e., light shielding portion is opaque or light blocking) the headlamp is appropriately configured as a right hand or left hand lamp. As indicated herein, most low-beam headlamps are specifically designed for use when driving on only one side of the road. Headlamps for use in left-traffic countries have low-beam headlamps that "dip to the left"; the light is distributed with a downward/leftward bias to show the driver the road and signs ahead without blinding oncoming traffic. Headlamps for right-traffic countries have low beams that "dip to the right", with most of their light directed downward/rightward. As described further herein, in further embodiments the light shielding portion is selectively configurable so that the head lamp is selectively configurable as either a right hand lamp or a left hand lamp.

As described further herein, in further embodiments the light shielding portion 130 includes an electrically switchable material which changes light transmission properties (transitions between opaque and transparency) when a voltage is applied to such material. In particular embodiments, such electrically switchable material includes an electrically switchable display panel as is known to those skilled, including but not limited an electrically switchable glass or glazing. Such glass or glazing is also sometimes referred to as switchable glass or intelligent glass.

Figure 5A:
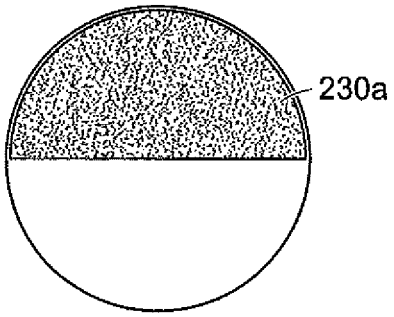
FIGS. 5A-C are illustrative views of different configurations or arrangements of a light shielding portion according to the present invention.
Figure 5B:
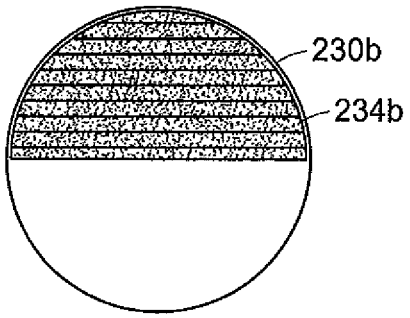
Figure 5C:
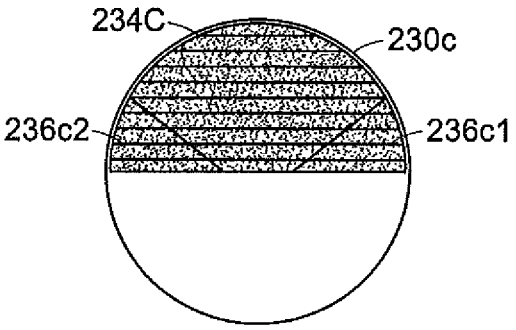

Referring now to FIGS. 5A-C, there are illustrative views of different configurations or arrangements of a light shielding portion 230*a-c* according to embodiments of the present invention. The light shielding portion 230*a* shown in FIG. 5A is configured so as to correspond to a portion of the circle that is representative of the lens. The shaded portion of the circle represent the part of the lens covered by the light shielding portion of the present invention.

The light shielding portion 230*b* shown in FIG. 5B is composed of a plurality of light shielding sections or strips 234*b* that extend widthwise. The strips 243*b* separate the light shielding portion into a plurality or a multiplicity of vertical sections that are electrically isolated from each other. In this way, the light pattern created by the light shielding portion can be changed by activating different sections or strips 234*b*. Such strips can be created for example, by adapting well known manufacturing techniques for liquid crystal displays.

Such a light shielding portion 230*b* and its capability to activate different sections or strips 234*b* advantageously allows one to create different light patterns that can be changed so as to allow for middle distance lighting and autoleveling. In addition, this functionality can be used to establish a different gradient cutoff so as to satisfy different light requirements.

The light shielding portion 230*c* shown in FIG. 5C is composed of a plurality of light shielding sections or strips 234*c* that extend widthwise and a plurality of light shielding regions that define side sections 236*c*1,2. The side sections are arrangable or configurable so as to include a single light shielding section or to include a plurality of light shielding sections or strips which are separately and selectively activated from the other plurality of light shielding sections or strips 234*c*. Reference should be made to the discussion above regarding FIG. 5B for details regarding the strips 234*c* of this embodiment.

As to the side sections 236*c*1,2, these sections are usable to establish different low beam patterns for the European or American markets, and also are controllable so one or the other pattern can be used. Thus, when defining a low beam pattern, the strips making up the side sections would be controlled or activated so as to establish the desired right hand or left hand light pattern. When the lamp is being operated under other conditions (mid-distance lighting, high beam), the strips for the side sections would be controlled or activated so as to create the desired light pattern. For example, when the lamp is operating as a high beam, the strips of the side sections would be controlled so that all the strips are transparent.

As indicated, the light shielding portion 130 includes an electrically switchable material which changes light transmission properties (transitions between opaque and transparency) when a voltage is applied to the material.

In particular embodiments, such electrically switchable material includes an electrically switchable display panel as is known to those skilled, including but not limited an electrically switchable glass or glazing. Such glass or glazing is also sometimes referred to as switchable glass or intelligent glass. The following describes some switchable glass or intelligent glass or other material which is operable so as to selectively create one of an opaque light state and a transparent light state.

It first should be recognized that smart glass generally describes an electrically switchable glass or glazing which changes light transmission properties when a voltage is applied and when it is removed. There are presently four types of such smart glass known in the art: Polymer Dispersed Liquid Crystal (PDLC), Suspended Particle Device (SPD), electrochromic and Reflective Hydride.

Figure 6A:
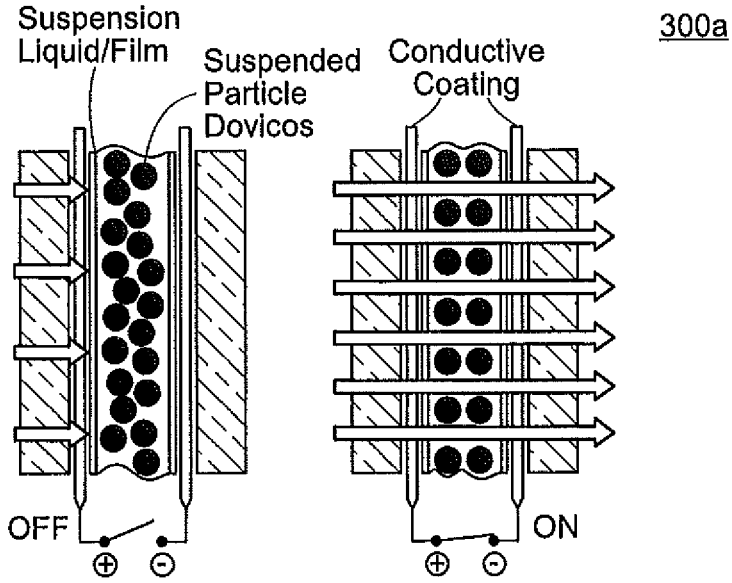
FIG. 6A is an illustrative cross-sectional view of an illustrative suspended particle device.

Referring now to FIG. 6A there is shown an illustrative cross-sectional view of an illustrative suspended particle device 300*c*. In such a device, the particles are suspended between two panels of glass and the glass is coated with a transparent conductive material. When electricity comes into contact with the particles via the conductive coating, they line up in a straight line, thereby allowing light to flow through and when the electricity is removed, the particles move back into a random pattern and thereby block light. When the amount of voltage is decreased, the glass darkens until it's completely dark with no voltage applied.

Figure 6B:
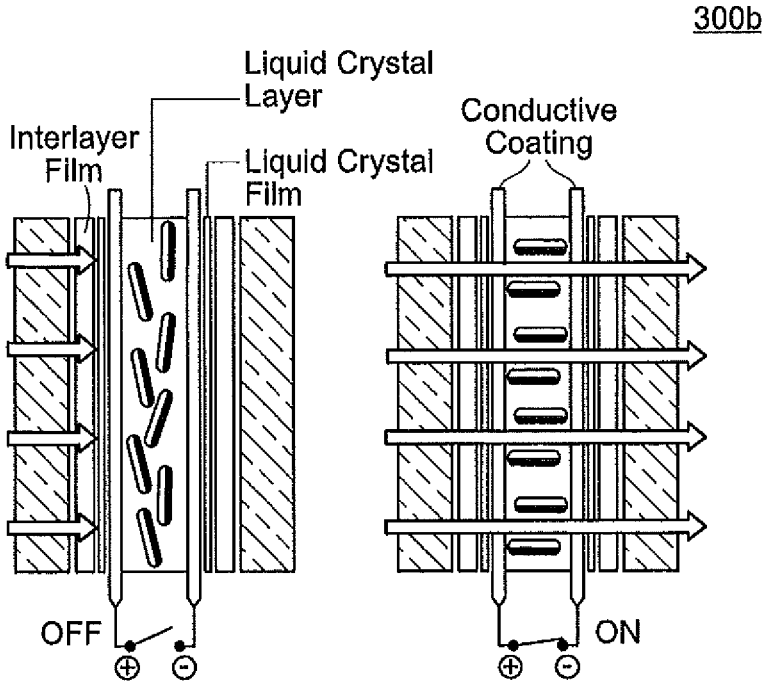
FIG. 6B is an illustrative cross-sectional view of an illustrative polymer dispersed liquid crystal (PDLC) device.

Referring now to FIG. 6B there is shown an illustrative cross-sectional view of an illustrative polymer dispersed liquid crystal (PDLC) device 300*b*, which is similar to the SPD device of FIG. 6A. In the PDLC device the liquid crystals respond to an electrical charge by aligning parallel thereby allowing light to pass and when the electrical charge is absent, the liquid crystals are randomly oriented to thereby block light. The glass is clear or translucent—there are no intermediate settings.

Figure 6C:
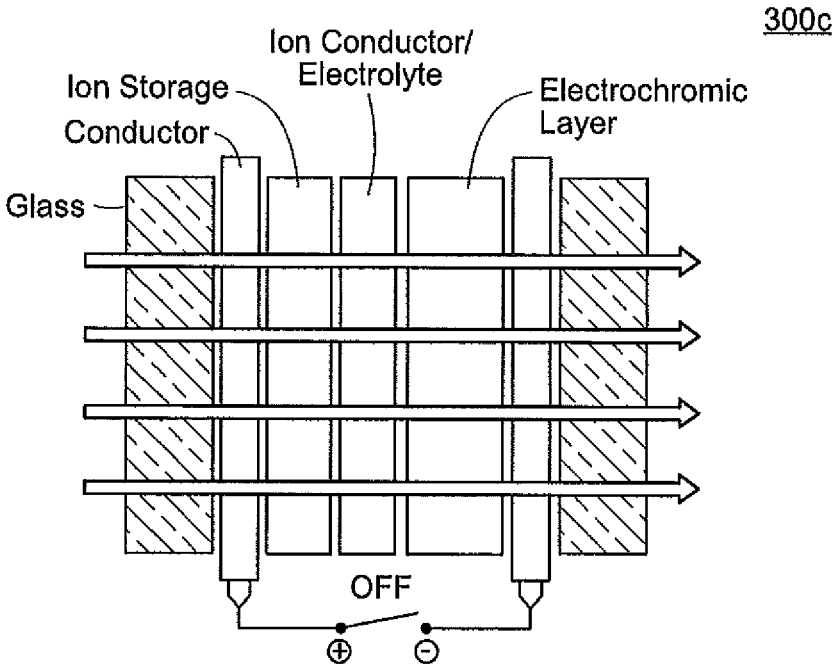
FIGS. 6C, D are illustrative cross-sectional views of an electrochromic device.
Figure 6D:
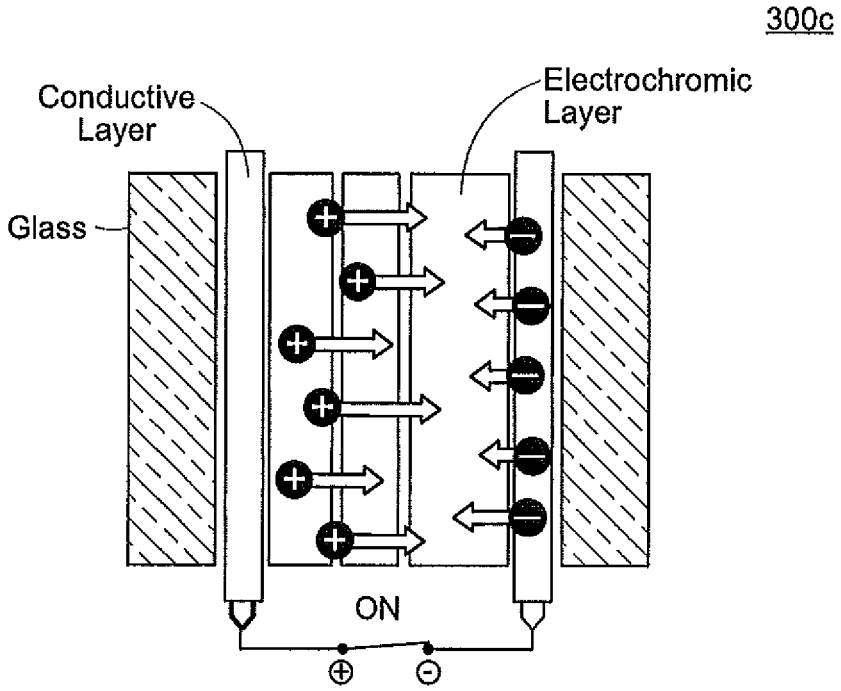
FIGS. 6E, F are illustrative views of a reflective hydride device.

Referring now to FIGS. 6C, D there are shown an illustrative cross-sectional views of an electrochromic device 300*c*. In such a device, the screen is dark when voltage is applied and is transparent when no voltage is applied. A voltage change initiates the processes, but is not required to maintain the state. Such electrochromic devices are commonly used in automotive mirrors. In such a device 300*c*, light blocking is based on light absorption.

Figure 1:
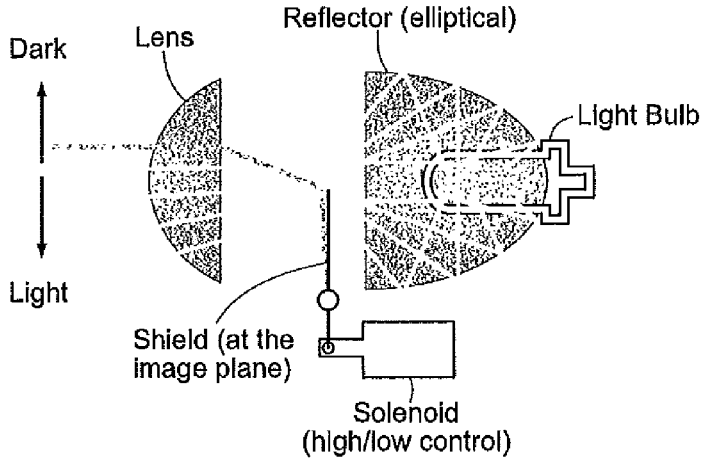
FIG. 1 (Prior Art)
FIG. 1 is a cross-sectional schematic view of a projector style headlamp, such as a high-intensity discharge (HID) type of projector style headlamp having a mechanically operated shield.
Figure 2:
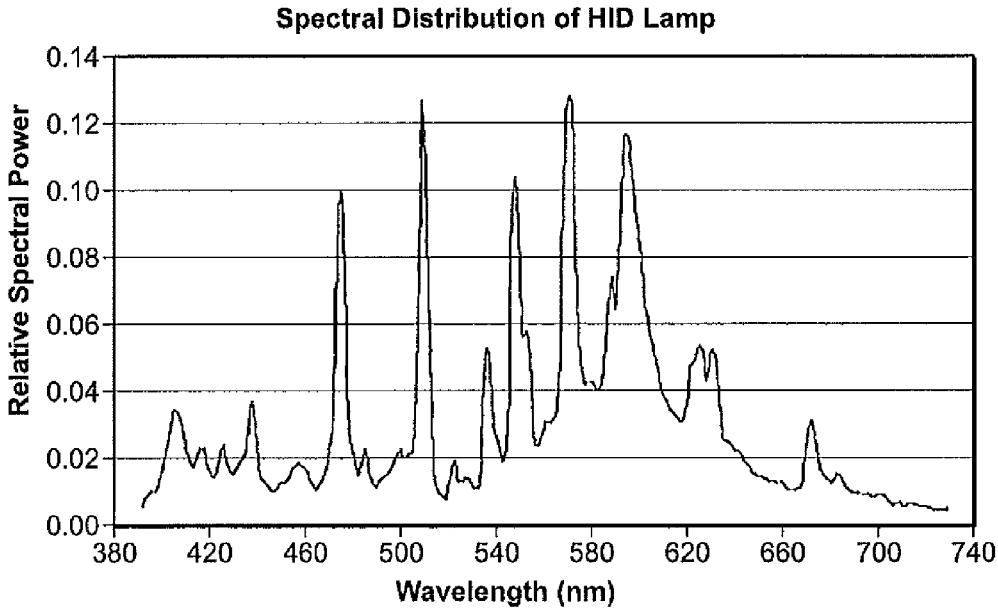
FIG. 2 (Prior Art)
FIG. 2 is a graphical view of an illustrative spectral distribution for an HID lamp.
Figure 3A:
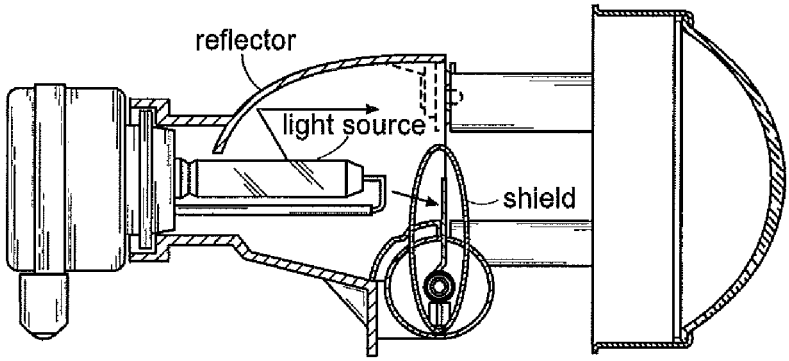
FIG. 3A PRIOR ART
FIGS. 3A, B are cross-sectional schematic views of a headlamp for a Lincoln MKS, when configured for low beam operation (FIG. 3A) and for high beam operation (FIG. 3B).
Figure 3B:
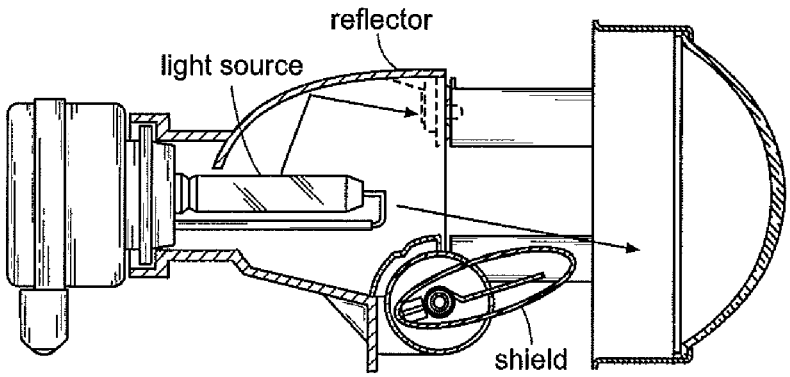
FIG. 3B PRIOR ART
Figures 1, 6E:
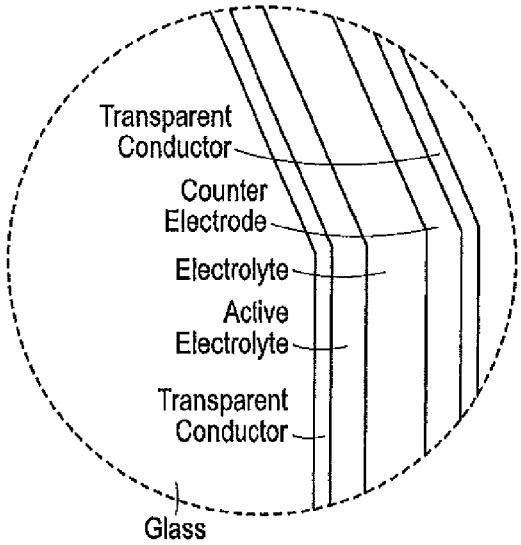
Figure 6E:
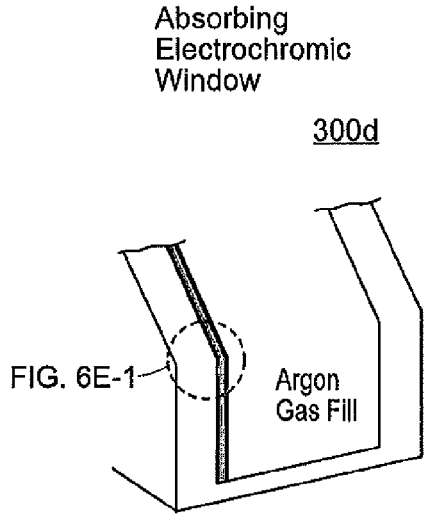
Figures 1, 6F:
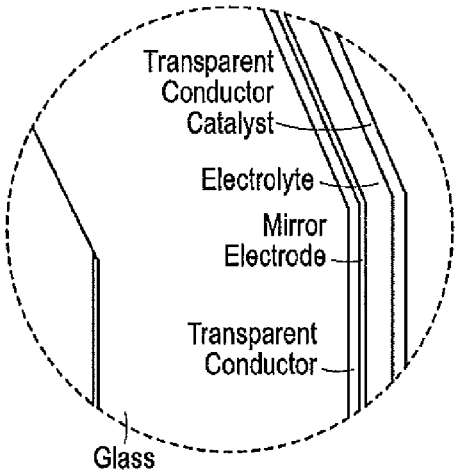
Figure 6F:
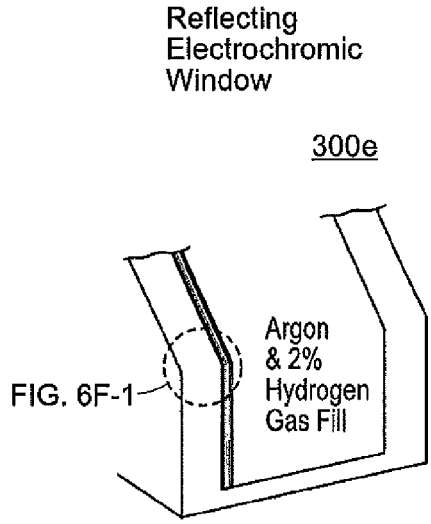

Referring now to FIGS. 6E, F there are shown an illustrative views of a reflective hydride device 300*e*. Although technically classified as electrochromic materials, light is reflected, instead of absorbed. Thin films (shown in exploded views FIGS. 6E-1, F-1) made of nickel-magnesium alloy are applied to a substrate and are able to switch back and forth from a transparent to a reflective state. The switch can be powered by low-voltage electricity (electrochromic technology). Such a reflective hydride device has the potential to be more energy efficient than other electrochromic materials.

Figure 7A:
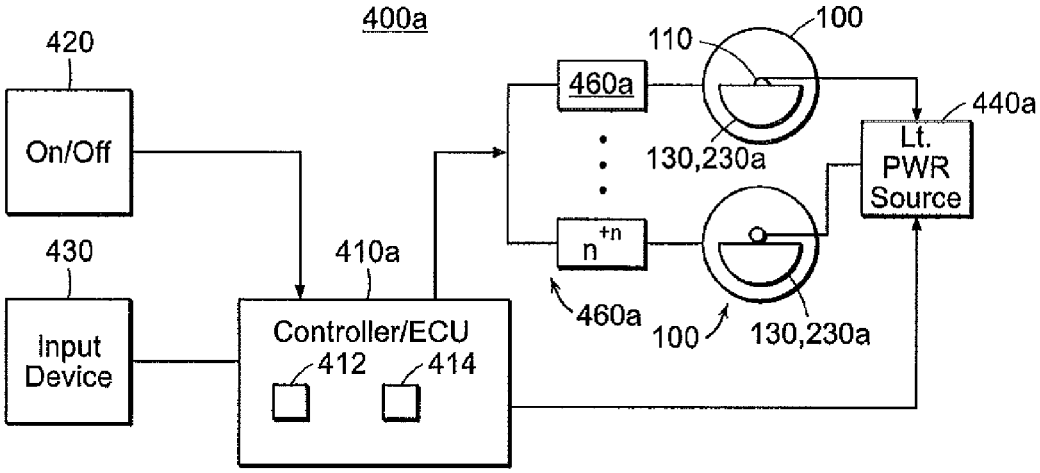
FIG. 7A is a schematic block diagram view of a control system for controlling a multi-functional project lamp or device according to an aspect of the present invention.
Figure 7B:
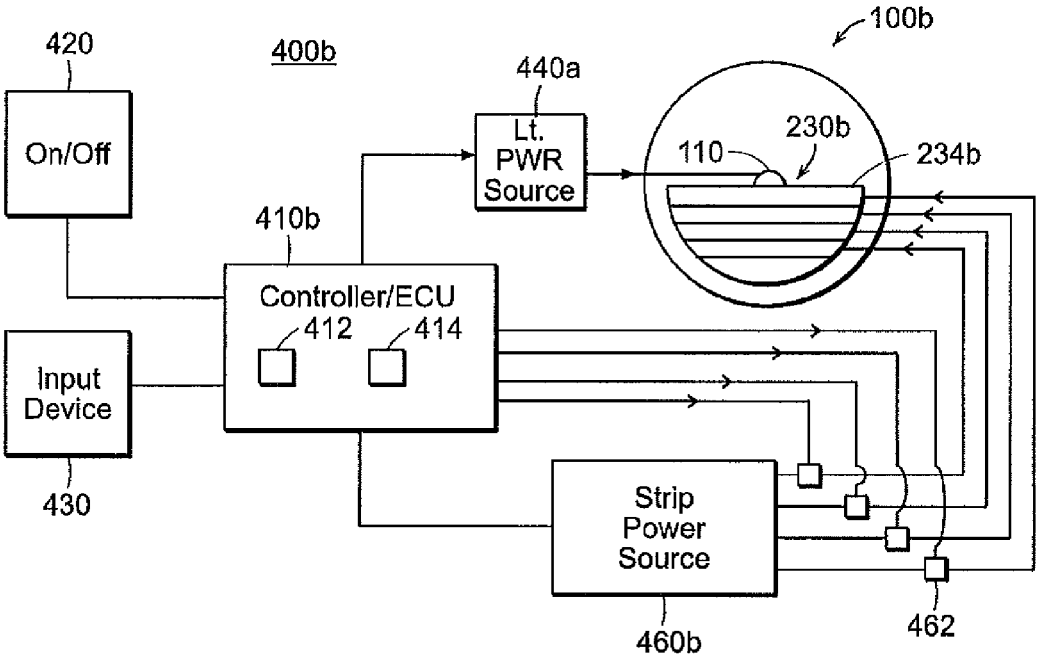
FIG. 7B is a schematic block diagram view of a control system for controlling a multi-functional project lamp or device according to another aspect of the present invention.

As indicated herein, in further aspects/embodiments of the present invention there is featured a control system for controlling a multi-functional projection lamp or vehicle lighting devices embodying such lamps according to any of the aspects and embodiments of the present invention such as those described herein. Referring now to FIGS. 7A, 7B there are shown illustrative schematic block diagram views of such control systems for controlling a multi-functional projection lamp or vehicle lighting devices embodying same according to the present invention such as those described herein. In a particular illustrative aspect/embodiment, FIG. 7A is an illustrative view of a control system 400*a* for controlling a multi-functional projection lamp 100 having a light shielding portion 130, 230*a* such as shown in FIGS. 4B and 5A. to another aspect of the present invention. In another particular illustrative aspect/embodiment, FIG. 7B is an illustrative view of a control system 400*a* for controlling a multi-functional projection lamp 100 having a light shielding portion 230*b* such as shown in FIG. 5B. It should be recognized that the control system illustrated in FIGS. 7A, 7B are easily adaptable to control the light shielding portion of a vehicle having one or more projection lamps or headlamps, such as motorcycles, automobiles, trucks, SUVs, and recreational vehicles such as RVs. As also discussed further herein, the following discussion also illustrates the structure of the logic of the different methodologies/inventions, which can be embodied in computer program software for execution on a computer, digital processor or microprocessor.

The illustrative control system 400*a* shown in FIG. 7A is depicted as being used to control operation of two projection lamps or lighting devices 100. This depiction shall not being limiting as it is within the scope of the present invention for a control system of the present invention to be capable of controlling one or more projection lamps or headlamps, such as those used with motorcycles, automobiles, trucks, SUVs, and recreational vehicles such as RVs.

As indicated herein and shown in FIG. 4A, such a lighting device 100 includes a light source 110, a reflector 120, a light shielding portion 130, a lens 140 and a housing 150. As also indicated herein, in an alternative embodiment, the light shielding portion 230*a* of FIG. 5A is usable as the light shielding portion of FIG. 7A. The light source 110 is any of a number of devices or mechanisms known to those skilled in the art or hereinafter developed that generate light at or about any of a number of frequencies and in more particular embodiments such light sources 110 include any light sources for use in vehicles including but not limited to halogen light bulbs or capsules, High Intensity Discharge (also called HID or Xenon) lamps and LEDs. Reference shall be made to the discussion concerning FIGS. 4A and 5A for further details regarding the other functionalities of such lighting devices unless otherwise provided herein.

The control system 400*a* of FIG. 7A includes a controller 410*a*, a switching mechanism or device 420 for turning the lighting devices more particularly the light source 110 or capsule On/Off, a light power source 440*a*; one or more power sources 460*a*, for activating the light shielding portion 130, 230*a* of each light device; and an input device 430 for inputting a signal(s) for changing the light distribution pattern being created by the lighting devices. Each of the switching mechanism/device 420, the light power source 440*a*, the one or more power sources 460*a*, and the input device 430 are operably/communicatively coupled to the controller 410*a* whereby the controller can receive input signals that provide operational instructions to control operational characteristics of each lighting device 100 and whereby the controller can output signal(s) to the appropriate functionality so as to control operation of the lighting device including controlling the light distribution pattern being produced.

The at least one light power source 440*a* of such a control system 400*a* is provided so as to power the light source for as long as it is desired to have the projection lamp provide external light. More particularly, such a light source is powered continuously for an extended period of time or is powered for a short period of time such as when a vehicle operator flashes the high beams.

The light power source 440*a* is preferably configured and arranged so as to provide the appropriate voltage and current necessary for powering the type of light source continuously for the extended time period or a shorter period of time such as for flashing the high beams. In more particular embodiments, such a light power source includes the power and control circuitry necessary for proper operation of a given type of light source (e.g., DC power or AC power circuitry). For example, HID lamps produce light from a millimeter-sized electric arc passing through a compressed mixture of xenon and metal halide gases contained in a light bulb or capsule. HID headlamp bulbs also do not usually run on low-voltage DC current but typically run on AC current. A ballast also is provided to control the current to the bulb, where the ballast has either an internal or external igniter. As such light power sources 440*a* are generally known in the art, such powers sources are not described further herein.

It also is within the scope of the present invention, for such a control system 400*a* to be configured with a plurality of light power sources 440*a* (e.g., one light source for each projection lamp). The control of such a light power source 440*a* is described below in connection with the operation of the controller 410*a*.

As described herein, the light shielding portion 130, 230*a* includes an electrically switchable material which changes light transmission properties (i.e., transitions between opaque and transparency or light transmissive) when a voltage/current is applied to such material. In particular embodiments, such electrically switchable material includes an electrically switchable display panel as is known to those skilled, including but not limited an electrically switchable glass or glazing. Such glass or glazing is also sometimes referred to as switchable glass or intelligent glass. In other words, the light shielding portion 130, 230*a* is appropriately activated so that it is either light transmissive/transparent or a light blocker and appropriately de-activated so the light shielding portion transitions to the opposite state (e.g., light blocker or light transmissive). As indicated herein, the materials making up the light shielding portion have different operational characteristics so that in come cases when a voltage is applied to the light shielding portion, it becomes transmissive whereas in another case the application of the voltage makes the light shielding portion light blocking.

The light shielding portion power source 460*a* is any of a number of power sources as are known to those skilled in the art that are adaptable so as to be configured and arranged so that in one case the power source provides the voltage and/or current necessary to cause the light shielding portion to be in either a light transmissive state or light blocking state and in another case the power source configures itself so the light shielding portion can transition to the other state. As such light power sources 440*a* are generally known in the art, such powers sources are not detailed nor described further herein.

While a plurality of light power sources 460*a*, one for each projection lamp is depicted in FIG. 7*a*, this is not limiting. It is within the scope of the present invention and the skill of those in the art to provide a circuit or device whereby a single power supply can be used to power each of the light shielding portion for each projection lamp or lighting device. The control of such a light power source(s) 440*a* is described below in connection with the operation of the controller 410*a*.

The switching mechanism 420 is any of a number of devices known to those skilled in the art for generating a signal to turn a lighting device or projection lamp ON when external light production is wanted/desired or a signal to turn the lighting device OFF when such external light production is not desired. In alternative embodiments, the switch mechanism is configurable so that when it is turned ON a circuit is completed and when it is turned OFF, the circuit is broken. In illustrative exemplary embodiments, the switching mechanism is a rotary type of switch that can be rotated between On and Off positions. Such switches can be mounted to a fixed surface such as the dashboard of the vehicle or integrated with a stalk type element that is mounted off the steering column. This are illustrative, as any of a number of such switching mechanisms as are known in the art or hereinafter developed can be used or adapted for use in such a control system 400*a*.

The input device 430 is any of a number of devices or mechanisms known to those skilled in the art that are configured and arranged so as to provide one or more signals, more particularly at least a plurality of signals and yet more particularly a multiplicity of signals, which signals in turn can be utilized to control the light distribution pattern being generated by the lighting device. In an illustrative exemplary embodiment, the input device 430 is a switch that generates one or more output signals that are each representative of a given position of the switch and thus corresponding to a desired light distribution pattern. In more particularly embodiments, one switch position of the input device 430 of FIG. 7A generates a signal so that the lighting device(s) 100 for the vehicle selectively changes from one light distribution pattern (e.g., low beam light distribution pattern) to a second light distribution pattern (e.g., high beam light distribution pattern). Such switches are well known in the art and need not be described further herein.

When the input device 430 is configured so as to generate a multiplicity of signals, each signal is established so as selectively change the light distribution pattern between a low beam light distribution pattern, a high beam light distribution pattern and one or more light distribution patterns intermediate the low and high beam. Such multi-position switches are well known in the art such as those used for controlling the movement (e.g., delayed movement) of wiper blades. In yet a further embodiment, the switching mechanism 420 and the input device 430 are integrated so as to form a unitary device that can be used to output signals for turning the lights on/off and for controlling the different light distribution patterns.

The controller 410*a* is a machine component that renders program code elements of a software program in a form that instructs a digital processing apparatus (e.g., computer, digital processor, microprocessor, application specific integrated circuit or ECU) to perform a sequence of function step(s). In the illustrated embodiment, the controller 410*a* includes a digital processor or microprocessor 412 on which is executed the software program (e.g., software program code elements) and a memory 414 that is operably coupled to the microprocessor to store program code and other data for operation of the software program. As is known to those skilled in the art, such a controller can further include storage devices for storing of the program and other operational data for purposes of controlling operation of the lighting device. Such a storage device preferably is a non-volatile type of memory and in further embodiments is the type of memory to which data and program code can be written and re-written (e.g., flash type memory or EPROM).

The following discussion also illustrates the structure of the logic of the different methodologies/inventions, which can be embodied in computer program software for execution on a computer, digital processor or microprocessor. Those skilled in the art will appreciate that this discussion illustrates the structures of the computer program code elements, including logic circuits on an integrated circuit, that function according to the present inventions. As such, the present inventions are practiced in its essential embodiments by a machine component that renders the program code elements in a form that instructs a digital processing apparatus (e.g., computer, digital processor, microprocessor, application specific integrated circuit or ECU) to perform a sequence of function step(s) corresponding to those described herein.

As is also known to those skilled in the art, the structures of the computer program code elements can be created using logic circuits on an integrated circuit, logic circuit elements and other circuitry. Thus, it also is within the scope of the present invention for the controller to be embodied in hardware that is configured and arranged to perform the herein described functions of the controller.

The switching mechanism 420 and the input device 430 are operably/communicatively coupled to the controller 410*a* using any of a number of techniques known to those skilled in the art so that the signals from each of the switching mechanism 420 and the input device 430 are received by the controller. More particularly, the software program embodied in the controller is configured so as to include code segments, instructions and criteria so as to continuously monitor the switching mechanism 420 and the input device 430 at least while the motor vehicle containing the multi-function lighting devices, is in an operating mode which allows for light generation by the lighting device.

The controller 410*a*, more particularly, the software program embodied in the controller and being executed on the processor 412 is configured so as to include code segments, instructions and criteria to determine from such monitoring if the switching mechanism 420 is configured in a lighting device ON position/state or in a lighting device OFF position/state. If the controller determines that the switching mechanism is in the lighting device ON position, the controller 410 causes the light source 440*a* to become energized so that the light source is outputting light which under the influence of the reflector 120 causes the light to go in an illumination direction (outwardly from the vehicle). More particularly, the software program being executed on the processor 412 of the controller, includes code segments, instructions and criteria that controls operation of the light power source 440*a* so that electrical power is provided to the light source 110 so it generates light.

The light power source 440*a* further includes a power supply and/or circuitry that further controls operation of the light power source so a given voltage and/or current is provided to the light source. For example, the light power source 440*a* can include a transformer or equivalent circuitry for stepping up or stepping down the input voltage as well as including circuitry for converting AC voltage to DC voltage and visa versa. In this way, the light source 110 can generate light for example to illuminate a road in the night time or to increase the visibility of the vehicle such as during adverse weather conditions.

As described herein, it is common while operating a motor vehicle for an operator to transition the lights between "low beam" and "high beam" depending upon driving conditions. Thus, a mechanism such as the input device 430 of the present invention is provided with the vehicle to allow the vehicle operator to switch between low and high beam. Thus, the controller 410*a*, more particularly, the software program embodied in the controller and being executed on the processor 412 is configured so as to include code segments, instructions and criteria to determine from such monitoring if the input device is configured so as to indicate a low beam operational state or a high beam operational state for the projection lamp/lighting device. Such a software program being also includes code segments, instructions and criteria for carrying out the below described functions in connection with high beam and low beam operation.

If the controller determines that the input device 430 is indicating high beam operation, the controller next determines if the projection lamp/lighting device is turned ON responsive to the switching mechanism 420 to generate light. If the lighting device is ON, then the controller controls the light shield portion power source 460*a* so the light shielding portion 130 is configured in the light transmissive state, whereby illuminating light that was being blocked by the light shielding portion can now pass there through. In the light transmissive state, the lighting device is configured so as to provide a high beam light distribution pattern. If the lighting device is not ON (i.e., is OFF) and the lighting device is not being operated to flash the high beams, the controller returns an error message and the light shielding portion 130 remains in the state it is in.

If the controller determines that the input device is indicating low beam operation, the controller determines if the projection lamp/lighting device has been just turned ON responsive to the switching mechanism to generate light. If the lighting device is determined to be just turned ON, the controller controls the light shield portion power source 460*a* so the light shielding portion 130 is configured in the light blocking state, whereby the illuminating light is blocked by the light shielding portion. In the light blocking state, the lighting device is configured so as to provide a low beam light distribution pattern.

If the controller determines that the input device is indicating low beam operation, the controller also determines if the projection lamp/lighting device is ON and is operating in high beam operational state. If yes, the controller controls the light shield portion power source 460*a* so the light shielding portion 130 is re-configured in the light blocking state, whereby the illuminating light is blocked by the light shielding portion. In other words, the lighting device transitions from a high beam light distribution pattern to a low beam light distribution pattern.

If the controller determines that the lighting device is not ON (i.e., is OFF), the controller returns an error message and the light shielding portion 130 remains in the state it is in.

As indicated herein, the vehicle provided mechanism for causing switching between low and high beam operation, also is adaptable or configurable to allow the vehicle operator to "flash" the high beams either when the projection lamps or lighting devices are ON in low beam operation or when the lamps/lighting devices are OFF. In the case where the lamps/lighting devices are ON, the controller controls the light shield portion power source 460*a* so the light shielding portion 130 is configured in the light transmissive state for a predetermined period of time and after expiration of this time period, the light shielding portion 130 is re-configured in the light blocking state.

If the controller 410 determines that the projection lamps or lighting devices are not ON, however, the controller causes the light power source 440*a* to become energized so that the light source 110 is outputting light and the controller also controls the light shield portion power source 460*a* so the light shielding portion 130 is configured in the light transmissive state. The controller 410 causes these actions to be performed for a predetermined time period and thereafter after expiration of this time period, the controller turns the light power source 440*a* off and returns the light shielding portion to its non-operational state.

In further embodiments, the predetermined time can be either a pre-established time period for flashing of the lights or the time the vehicle operator operates the mechanism for flashing of the lights.

Referring now to FIG. 7B, there is shown another schematic block diagram view of a control system 400*b* for controlling a multi-functional project lamp or device according to another aspect of the present invention. As described herein in connection with FIGS. 5A-C, the light shielding portion is configurable so as to present any of a number of different configurations such as the light shielding portion 130, 230*a* described above in connection with FIG. 7A in which the light shielding portion includes one light shielding section and the light shielding portions that are made up of a plurality, more specifically a multiplicity of light shielding sections, such as those shown in FIGS. 5B, C. that are electrically isolated from each other.

Although the control system 410*b* of FIG. 7B describes the control system using the light shielding portion 230*b* shown in FIG. 5B, this shall not be considered limiting as such a control system is easily adaptable to control light shielding portions that are composed of a plurality of strips or other section arrangements such as, for example, the light shielding portion 230*c* as shown in FIG. 5C. While the arrangement depicted in FIG. 5C also involves the use of strips, it s within the scope of the present invention for the main and side segments 234*c*, 234*c*1, 234*c*2 (FIG. 5C) thereof to be arranged so that one or more segments comprises one light shielding section, where each of the light shielding sections are electrically isolated from each other.

Reference shall be made to the discussion above for FIG. 7A for functionalities that are in common to the different control systems as well as the description for a light device except otherwise provided below. Such functionalities include but are not limited to the switching mechanism 420, the input device 430, the light power source 440*a*, and the light source 110.

As indicated above, the light shielding portion 230*c* is composed of a plurality of sections or strips that are electrically isolated from each other. In such an arrangement, each strip can be separately controlled such that one or more strips can be controlled such that they are in a light transmissive state while other strips are controlled so they are in a light blocking state. In this way, the lighting device can be controlled so that a multiplicity of different light distribution patterns can be created intermediate the light distribution patterns for low beam and high beam operation.

In further embodiments, any one of a number of techniques or devices could be used that would provide a signal(s) to the controller 410 so as to allow the controller (the applications or software program being executed thereon) to determine if the vehicle is not level (front to back) and from this information, the controller 410 also can determine if the low beam cut-off established for the light shielding portion should be adjusted because of this determined out of level condition. In other words, the controller can automatically adjust the cut-off to counter at least in part the effect that the out of level condition has on the vehicle lighting device(s).

As is known to those skilled in the art, lighting criterion is not uniform throughout the different countries or regions for the world, for example, the lighting criterion in Europe differs from that established in the US. In yet further embodiments, such a light shielding portion including a plurality or multiplicity of the individual light shielding sections provides a mechanism by which a vehicle operator can adjust the control parameters for controlling the different light shielding sections so as to satisfy local lighting criterion. In this way, a projection lamp or lighting device can be provided that does not have to be customized structurally to meet each set of local lighting criterion.

As the strips of the light shielding portion are capable of being individually controlled, the control system includes a section/strip power source 460*b* and a plurality of switches 462 operably connected to the section/strip power source. In alternative embodiments, the switches are embodied in the section/strip power source so that such a power source has switchable outputs. Such a light shielding portion power source 460*b* is any of a number of power sources as are known to those skilled in the art that are adaptable so as to be configured and arranged so that in one case the power source provides the voltage and/or current necessary to cause each light shielding section to be in either a light transmissive state or light blocking state and in another case the power source configures itself so one or more of the light shielding sections can transition to the other state. The switches 462 are any of a number of devices or circuit elements that can be used to interrupt the flow of current and voltage from the section/strip power source 460*b* to a respective strip or section of the light shielding portion 230*b*. As such power sources 460*b* and switches are generally known in the art, they are not detailed nor described further herein.

The controller 410 has the same general structural makeup as that described above in connection with FIG. 7A and thus is not repeated here. The controller 410*b* differs from the description of FIG. 7A in that the software program (i.e., code segments, instructions and criteria thereof) for execution on the processor 412 of the controller 410*b* differs from the software program being executed on the processor 412 of the controller 410*a* of FIG. 7A.

As provided herein, the software program embodied in the controller 410*b* is configured so as to include code segments, instructions and criteria so as to continuously monitor the switching mechanism 420 and the input device 430 at least while the motor vehicle containing the multi-function lighting devices, is in an operating mode which allows for light generation by the lighting device. The controller 410*b*, more particularly, the software program embodied in the controller and being executed on the processor 412 is configured so as to include code segments, instructions and criteria to determine from such monitoring if the switching mechanism 420 is configured in a lighting device ON position/state or in a lighting device OFF position/state. If the controller determines that the switching mechanism is in the lighting device ON position, the controller 410*b* causes the light source 440*a* to become energized so that the light source is outputting light which under the influence of the reflector 120 causes the light to go in an illumination direction (outwardly from the vehicle). More particularly, the software program being executed on the processor 412 of the controller, includes code segments, instructions and criteria that controls operation of the light power source 440*a* so that electrical power is provided to the light source 110 so it generates light. Reference shall be made to the discussion regarding FIG. 7A as to further details about the light power source 440*a*.

As described herein, it is common while operating a motor vehicle for an operator to transition the lights between "low beam" and "high beam" depending upon driving conditions. As also described above, the control system of FIG. 7B is configured so as to separately and individually control the different light shielding sections or strips making up the light shielding portion. Thus, and as described above, a mechanism such as the input device 430 is provided with the vehicle to allow the vehicle operator to in effect separately control the different sections or to control all of the sections so the lighting device can switch between a low and high beam light distribution pattern.

Thus, the controller 410*b*, more particularly, the software program embodied in the controller and being executed on the processor 412 is configured so as to include code segments, instructions and criteria to determine from such monitoring if the input device signal corresponds to an instruction to configure the lighting device for a low beam operational state, a high beam operational state and operational state intermediate the low and high beam states, or to take some other action (e.g., flashing high beams). Such a software program being also includes code segments, instructions and criteria for carrying out the below described functions in connection with such operations.

If the controller determines that the input device 430 is indicating high beam operation, the controller next determines if the projection lamp/lighting device is turned ON responsive to the switching mechanism 420 to generate light. If the lighting device is ON, then the controller controls the light shield portion power source 460*b* and switches 462 so the light shielding portion 230*b* is configured in the light transmissive state, whereby illuminating light that was being blocked by the light shielding portion can now pass there through. In this state, the lighting device is configured so as to provide a high beam light distribution pattern. If the lighting device is not ON (i.e., is OFF) and the lighting device is not being operated to flash the high beams, the controller returns an error message and the light shielding portion 230*b* remains in the state it is in.

If the controller determines that the input device is indicating low beam operation, the controller determines if the projection lamp/lighting device has been just turned ON responsive to the switching mechanism to generate light. If the lighting device is determined to be just turned ON, the controller controls the light shield portion power source 460*b* and the switches so the light shielding portion 230*b* is configured in the light blocking state, whereby the illuminating light is blocked by the light shielding portion. In the light blocking state, the lighting device is configured so as to provide a low beam light distribution pattern.

If the controller determines that the input device is indicating low beam operation, the controller also determines if the projection lamp/lighting device is ON and is operating in high beam operational state. If yes, the controller controls the light shield portion power source 460*b* and/or switches so the light shielding portion 230*b* is re-configured in the light blocking state, whereby the illuminating light is blocked by the light shielding portion. In other words, the lighting device transitions from a high beam light distribution pattern to a low beam light distribution pattern.

If the controller determines that the lighting device is not ON (i.e., is OFF), the controller returns an error message and the light shielding portion 230*b* remains in the state it is in.

As indicated herein, the input device is configurable so as to allow the vehicle operator to "flash" the high beams either when the projection lamps or lighting devices are ON in low beam operation or when the lamps/lighting devices are OFF. In the case where the lamps/lighting devices are ON, the controller controls the light shield portion power source 460*a* and switches 462 so the light shielding portion 230*b* is configured in the light transmissive state for a predetermined period of time and after expiration of this time period, the light shielding portion 230*b* is re-configured in the light blocking state.

If the controller 410 determines that the projection lamps or lighting devices are not ON, the controller causes the light power source 440*a* to become energized so that the light source 110 is outputting light and the controller also controls the light shield portion power source 460*b* and switches 462 so the light shielding portion 230*b* is configured in the light transmissive state. The controller 410 causes these actions to be performed for a predetermined time period and thereafter after expiration of this time period, the controller turns the light power source 440*a* off and returns the light shielding portion to its non-operational state.

In further embodiments, the predetermined time can be either a pre-established time period for flashing of the lights or the time the vehicle operator operates the mechanism for flashing of the lights.

As indicated above, the individual sections or strips can be controlled individually so that the lighting device provides an appropriate cut-off according to the local lighting criterion. In such a case, the controller 410*b* includes data establishing what sections or strips of the light shielding portion should be maintained in a light transmissive state during all operational phases so as to maintain the appropriate cut-off. Thus, when the controller is controlling the light shielding portion (e.g., light shielding sections or strips) so as to establish a light blocking state, the controller controls the predetermined sections or strips of the light shielding portion that should be maintained in a light transmissive state during all operational phases so that these sections/strips are not put into a light blocking state.

As also indicated above, it is within the scope of the present invention for sections or strips of the light shielding portion to be controlled so that when the lighting device is ON, it can produce one or more light distribution patterns that are intermediate the low and high beam distribution patterns. Thus, the controller 410*b*, more particularly, the software program embodied in the controller and being executed on the processor 412 determines from the signal from the input device 430 if the signal corresponds to an instruction to configure the lighting device in an operational state intermediate the low and high beam states, or to take some other action (e.g., flashing high beams). If the signal provides such an instruction, the controller 410*b*, more particularly, the software program embodied in the controller and being executed on the processor 412 also determines what sections or strips should be light transmissive and which should be light blocking. For example, a look-up chart is provided that relates such light transmissive and light blocking information a given signal. Based on this determination, the controller controls the light shielding portion power source 460*a* and switches 462 so the light shielding portion 230*b* is configured so as to make the determined sections that should be light transmissive, light transmissive and so as to make the determined sections that should be light blocking, light blocking.

As also indicated above, it is within the scope of the present invention to adapt the control system 400*b* so as to control the main and side sections 234*c*, 234*c*1, 234*c*2 of the light shielding portion 230*c* shown in FIG. 5C. As described herein, the side sections 234*c*1, 234*c*2 are separately controlled so as to establish different low beam patterns for the European or American markets (i.e., to establish the desired right hand or left hand light pattern) and also are controllable so one or the other pattern can be used. Thus, the controller 410*b* is configured to include information (e.g., another look-up table) that correlates the desired right hand or left hand light pattern to a given country or region and is inputted or provided with the country or region in which the vehicle is permanently or temporarily driving. Based on this information, the controller thereafter automatically controls the side sections 234*c*1, 234*c*2 so as to be light transmissive or light blocking so that the lighting device in at least low beam operation has the desired right hand or left hand light pattern.

Although a preferred embodiment of the invention has been described using specific terms, such description is for illustrative purposes only, and it is to be understood that changes and variations may be made without departing from the spirit or scope of the following claims.

INCORPORATION BY REFERENCE

All patents, published patent applications and other references disclosed herein are hereby expressly incorporated by reference in their entireties by reference.

EQUIVALENTS

Those skilled in the art will recognize, or be able to ascertain using no more than routine experimentation, many equivalents of the specific embodiments of the invention described herein. Such equivalents are intended to be encompassed by the following claims.

What is claimed is:

1. A multi-functional light shielding plate to establish a desired light distribution pattern to light traveling in an illumination direction that is received from at least one of a light source or a reflector, said multi-functional light shielding plate comprising:

a light shielding portion that is selectively configurable so as to be one of transmissive to said light traveling in the illumination direction or a light blocker;

a support mechanism that supports the light shielding portion so as to maintain the light shielding portion in fixed relation with respect to the light source;

wherein when configured as a light blocker, the light shielding portion is configured so that said light traveling in the illumination direction is substantially blocked from passing through the light shielding portion and thus forms a first light distribution pattern; and wherein when configured so as to be transmissive, the light shielding portion is configured so that said light traveling in the illumination direction passes substantially through the light shielding plate and thus forms a second light distribution pattern, wherein the light shielding portion is further configurable so one segment of the light shielding portion is configured as being transmissive and so a second segment of the light shielding portion is configured as a light blocker, thereby forming a third light distribution pattern.

2. The multi-functional light shielding plate of claim 1, wherein:

the light shielding portion is configured with a main segment and two auxiliary segments, the main segment and each of the auxiliary segments being selectively configurable so as to be one of transmissive or a light blocker, wherein when the light shield portion main segment is configured as a light blocker, the main segment is configured so that said light traveling in the illumination direction is substantially blocked from passing through the main segment; and wherein the two side segments are configured so one side segment is a light blocker and the other side segment is transmissive when the main segment is configured as a light blocker, whereby the main and two auxiliary segments form a fourth light distribution pattern.

3. The multi-functional light shielding plate of claim 2, wherein the side segments are respectively configured as being a light blocker and light transmissive so that the fourth light distribution pattern is compatible with traffic directionality requirements for the country in which the vehicle is traveling on a permanent or semi-permanent basis.

4. The multi-functional light shielding plate of claim 1, wherein the light shielding portion includes an electrically switchable material whose light transmission properties change when voltage is applied to the electrically switchable material.

5. The multi-functional light shielding plate of claim 4, wherein the electrically switchable material is selected from the group consisting of a suspended particle device, a polymer dispersed liquid crystal, an electrochromic device and a reflective hydride.

6. The multi-functional light shielding plate of claim 4, wherein the electrically switchable material includes an electrically switchable glass or glazing.

7. The multi-functional plate of claim 1 further comprising: a controller that is operably coupled to light shielding portion, the controller being configured and arranged so as to control the operational configuration of the light shielding portion, wherein the controller is configured so as to cause the light shielding portion to be selectively configured as one of transmissive or a light blocker.

8. A multi-functional light shielding plate to establish a desired light distribution pattern to light traveling in an illumination direction that is received from at least one of a light source or a reflector, said multi-functional light shielding plate comprising:

a light shielding portion that is selectively configurable so as to be one of transmissive to said light traveling in the illumination direction or a light blocker;

a support mechanism that supports the light shielding portion so as to maintain the light shielding portion in fixed relation with respect to the light source;

wherein when configured as a light blocker, the light shielding portion is configured so that said light traveling in the illumination direction is substantially blocked from passing through the light shielding portion and thus forms a first light distribution pattern; and wherein when configured so as to be transmissive, the light shielding portion is configured so that said light traveling in the illumination direction passes substantially through the light shielding plate and thus forms a second light distribution pattern, wherein the light shielding portion is configured with a main segment and two auxiliary segments, the main segment and each of the auxiliary segments being selectively configurable so as to be one of transmissive or a light blocker, wherein when the light shield portion main segment is configured as a light blocker, the main segment is configured so that said light traveling in the illumination direction is substantially blocked from passing through the main segment; and wherein the two side segments are configured so one side segment is a light blocker and the other side segment is transmissive when the main segment is configured as a light blocker, whereby the main and two auxiliary segments form another light distribution pattern.

9. The multi-functional light shielding plate of claim 8, wherein the side segments are respectively configured as being a light blocker and light transmissive so that the formed another light distribution pattern is compatible with traffic directionality requirements for the country in which the vehicle is traveling on a permanent or semi-permanent basis.

10. A multi-functional projection type lighting device comprising:

a light source; and a multi-functional light shielding plate to establish a desired light distribution pattern to light traveling in an illumination direction that is received from at least the light source or a reflector, said multi-functional light shielding plate including:

a light shielding portion that is selectively configurable so as to be one of transmissive to said light traveling in the illumination direction or a light blocker;

a support mechanism that supports the light shielding portion so as to maintain the light shielding portion in fixed relation with respect to the light source;

wherein when configured as a light blocker, the light shielding portion is configured so that said light traveling in the illumination direction is substantially blocked from passing through the light shielding portion and thus forms a first light distribution pattern; and wherein when configured so as to be transmissive, the light shielding portion is configured so that said light traveling in the illumination direction passes substantially through the light shielding plate and thus forms a second light distribution pattern, wherein the light shielding portion is further configurable so one segment of the light shielding portion is configured as being transmissive and so a second segment of the light shielding portion is configured as a light blocker, thereby forming a third light distribution pattern.

11. The multi-functional projection type lighting device of claim 10, further comprising a reflector that is arranged so it reflects light from the light source in the illumination direction and wherein the multi-functional light shielding plate is configured so as to establish a desired light distribution pattern to light traveling in an illumination direction that is received from at least one of the light source or the reflector.

12. The multi-functional projection type lighting device of claim 11, further comprising a lens that is arranged so that a beam of light in the illumination direction passes through the lens and so the lens gives the light beam its final shape.

13. The multi-functional projection type lighting device of claim 10, wherein:

the light shielding portion is configured with a main segment and two auxiliary segments, the main segment and each of the auxiliary segments being selectively configurable so as to be one of transmissive or a light blocker, wherein when the light shield portion main segment is configured as a light blocker, the main segment is configured so that said light traveling in the illumination direction is substantially blocked from passing through the main segment; and wherein the two side segments are configured so one side segment is a light blocker and the other side segment is transmissive when the main segment is configured as a light blocker, whereby the main and two auxiliary segments form a fourth light distribution pattern.

14. The multi-functional projection type lighting device of claim 13, wherein the side segments are respectively configured as being a light blocker and light transmissive so that the fourth light distribution pattern is compatible with traffic directionality requirements for the country in which the vehicle is traveling on a permanent or semi-permanent basis.

15. The multi-functional projection type lighting device of claim 10, wherein the light shielding portion includes an electrically switchable material whose light transmission properties change when voltage is applied to the electrically switchable material.

16. The multi-functional projection type lighting device of claim 15, wherein the electrically switchable material is selected from the group consisting of a suspended particle device, a polymer dispersed liquid crystal, an electrochromic device and a reflective hydride.

17. The multi-functional projection type lighting device of claim 15, wherein the electrically switchable material includes an electrically switchable glass or glazing.

18. The multi-functional projection type lighting device of claim 10, further comprising a housing; wherein the light source is mechanically coupled to the housing so as to secure the light source in fixed relation to the housing; and wherein the support mechanism is mechanically coupled to the housing, whereby the light shielding portion is maintained in fixed relation to the housing and thus also with respect to light source.

19. The multi-functional projection type lighting device of claim 10 further comprising: a controller that is operably coupled to light shielding portion, the controller being configured and arranged so as to control the operational configuration of the light shielding portion, wherein the controller is configured so as to cause the light shielding portion to be selectively configured as one of transmissive or a light blocker.

20. A multi-functional projection type lighting device comprising:

a light source; and a multi-functional light shielding plate to establish a desired light distribution pattern to light traveling in an illumination direction that is received from at least the light source or a reflector, said multi-functional light shielding plate including:

a light shielding portion that is selectively configurable so as to be one of transmissive to said light traveling in the illumination direction or a light blocker;

a support mechanism that supports the light shielding portion so as to maintain the light shielding portion in fixed relation with respect to the light source;

wherein when configured as a light blocker, the light shielding portion is configured so that said light traveling in the illumination direction is substantially blocked from passing through the light shielding portion and thus forms a first light distribution pattern; and wherein when configured so as to be transmissive, the light shielding portion is configured so that said light traveling in the illumination direction passes substantially through the light shielding plate and thus forms a second light distribution pattern, wherein the light shielding portion is configured with a main segment and two auxiliary segments, the main segment and each of the auxiliary segments being selectively configurable so as to be one of transmissive or a light blocker;

wherein when the light shield portion main segment is configured as a light blocker, the main segment is configured so that said light traveling in the illumination direction is substantially blocked from passing through the main segment; and wherein the two side segments are configured so one side segment is a light blocker and the other side segment is transmissive when the main segment is configured as a light blocker, whereby the main and two auxiliary segments form another light distribution pattern.

21. The multi-functional projection type lighting device of claim 20, wherein the side segments are respectively configured as being a light blocker and light transmissive so that the formed another light distribution pattern is compatible with traffic directionality requirements for the country in which the vehicle is traveling on a permanent or semi-permanent basis.

22. A vehicle lighting device comprising:

a light source;

a reflector that is arranged so it reflects light from the light source in the illumination direction;

a multi-functional light shielding plate configured so as to establish a desired light distribution pattern to light traveling in an illumination direction that is received from at least the light source or a reflector, said multi-functional light shielding plate including:

a light shielding portion that is selectively configurable so as to be one of transmissive to said light traveling in the illumination direction or a light blocker;

a support mechanism that supports the light shielding portion so as to maintain the light shielding portion in fixed relation with respect to the light source;

wherein when configured as a light blocker, the light shielding portion is configured so that said light traveling in the illumination direction is substantially blocked from passing through the light shielding portion and thus forms a first light distribution pattern;

wherein when configured so as to be transmissive, the light shielding portion is configured so that said light traveling in the illumination direction passes substantially through the light shielding plate and thus forms a second light distribution pattern, wherein the light shielding portion is further configurable so one segment of the light shielding portion is configured as being transmissive and so a second segment of the light shielding portion is configured as a light blocker, thereby forming a third light distribution pattern.

23. The vehicle lighting device of claim 22, wherein the light shielding portion includes an electrically switchable material whose light transmission properties change when voltage is applied to the electrically switchable material.

24. The vehicle lighting device of claim 23, wherein the electrically switchable material is selected from the group consisting of a suspended particle device, a polymer dispersed liquid crystal, an electrochromic device and a reflective hydride.

25. The vehicle lighting device of claim 23, wherein the electrically switchable material includes an electrically switchable glass or glazing.

26. The vehicle lighting device of claim 22, further comprising a housing; wherein the light source is mechanically coupled to the housing so as to secure the light source in fixed relation to the housing; and wherein the support mechanism is mechanically coupled to the housing, whereby the light shielding portion is maintained in fixed relation to the housing and thus also with respect to light source.

27. The vehicle light device of claim 22, wherein the light source comprises a high intensity discharge type of light source.

28. The vehicle light device of claim 22, further comprising a lens that is arranged so that a beam of light in the illumination direction passes through the lens and configured so the lens gives the light beam its final shape.

29. The vehicle lighting device of claim 22, further comprising: a controller that is operably coupled to light shielding portion, the controller being configured and arranged so as to control the operational configuration of the light shielding portion, wherein the controller is configured so as to cause the light shielding portion to be selectively configured as one of transmissive or a light blocker.

* * * * *